US009004634B2

(12) United States Patent
Maesaka et al.

(10) Patent No.: US 9,004,634 B2
(45) Date of Patent: Apr. 14, 2015

(54) INKJET PRINTER

(71) Applicant: Riso Kagaku Corporation, Tokyo (JP)

(72) Inventors: Toshihide Maesaka, Ibaraki-ken (JP); Mamoru Saitou, Ibaraki-ken (JP); Takashi Ebisawa, Ibaraki-ken (JP); Ryo Terakado, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/827,995

(22) Filed: Mar. 14, 2013

(65) Prior Publication Data

US 2013/0249986 A1 Sep. 26, 2013

(30) Foreign Application Priority Data

Mar. 23, 2012 (JP) ..... 2012-067157
Sep. 12, 2012 (JP) ..... 2012-200385

(51) Int. Cl.

| | |
|---|---|
| ***B41J 29/38*** | (2006.01) |
| ***B41J 2/045*** | (2006.01) |
| ***B41J 2/15*** | (2006.01) |
| ***B41J 2/155*** | (2006.01) |

(52) U.S. Cl.

CPC ..... *B41J 2/04588* (2013.01); *B41J 2/04505* (2013.01); *B41J 2/04563* (2013.01); *B41J 2/04573* (2013.01); *B41J 2/04581* (2013.01); *B41J 2/04596* (2013.01); *B41J 2/15* (2013.01); *B41J 2/155* (2013.01)

(58) Field of Classification Search

USPC ..... 347/14, 12

See application file for complete search history.

(56) References Cited

U.S. PATENT DOCUMENTS

2010/0289843 A1* 11/2010 Tomizawa et al. ..... 347/14

FOREIGN PATENT DOCUMENTS

JP 2010-173178 A 8/2010

* cited by examiner

*Primary Examiner* — Julian Huffman

(74) *Attorney, Agent, or Firm* — Nath, Goldberg & Meyer; Jerald L. Meyer; Tiffany A. Johnson

(57) ABSTRACT

An inkjet printer includes nozzle rows aligned along a printing direction along which printing on a print medium is executed, and a controller configured to control ejection of the ink droplets from the nozzle rows. The nozzle rows include a pair of an upstream nozzle row and a downstream nozzle row. The upstream nozzle row is positioned just upstream from the downstream nozzle row along the printing direction. The controller controls ejection of the ink droplets from the upstream nozzle row and the downstream nozzle row so that propulsive forces applied to ink droplets ejected from the downstream nozzle row are made larger, based on image data associated with the upstream nozzle row, than propulsive forces applied to ink droplets ejected from the upstream nozzle row. The inkjet printer can restrict degradation of print quality by landing the ink droplets ejected from the downstream nozzle at their target positions.

11 Claims, 12 Drawing Sheets

FIG. 2C
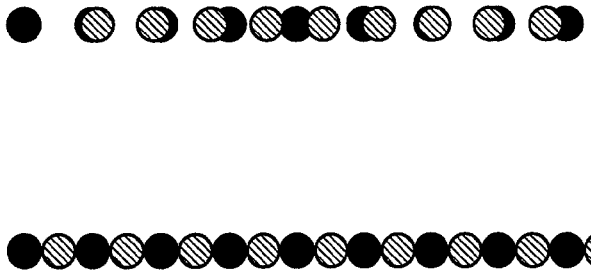
FIG. 2B
FIG. 2A
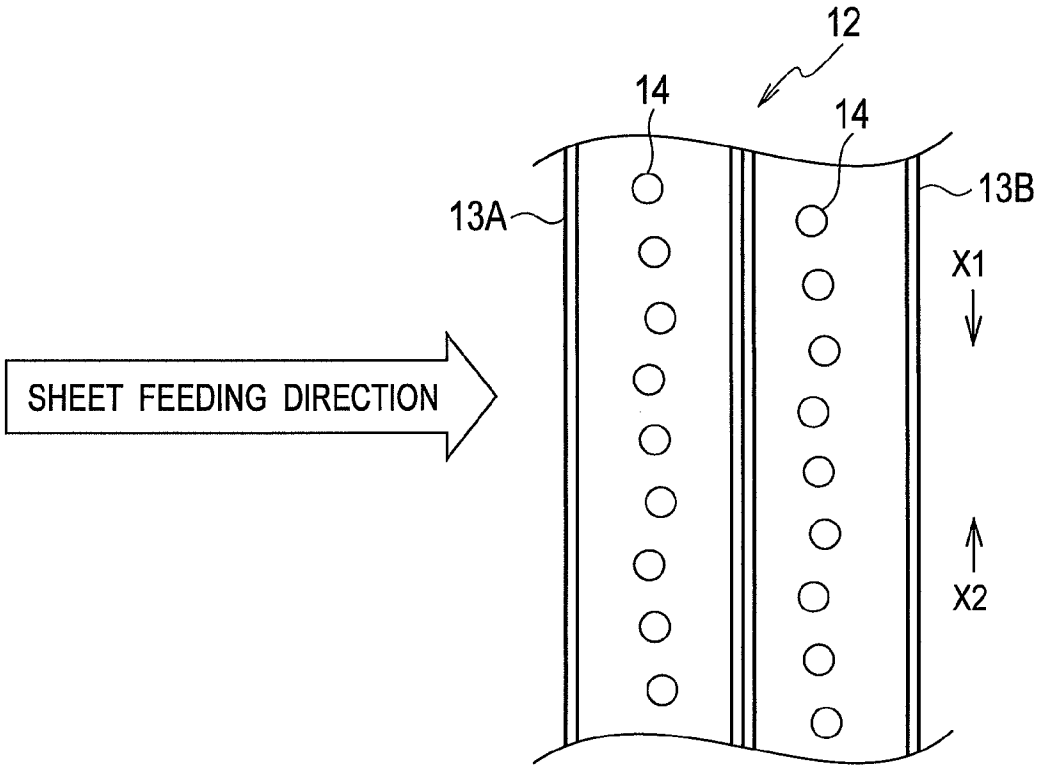

INKJET PRINTER

BACKGROUND OF THE INVENTION

1. Technical Field

The present invention relates to an inkjet printer in which inkjet heads for ejecting ink from its nozzles based on image data and a print medium are moved relatively to each other.

2. Background Arts

Generally, well-known is an inkjet printer in which inkjet heads for ejecting ink from its nozzles based on image data and a print medium are moved relatively to each other.

A line-type inkjet printer includes plural inkjet heads for ejecting ink aligned along a primary sweeping direction perpendicular to a secondary sweeping direction (=a feeding direction of a print sheet fed on a sheet feed path). Namely, the secondary sweeping direction is parallel to the sheet feeding direction. In such a line-type inkjet printer, airflow may be generated by print sheet feeding. In addition, airflow from the inkjet heads toward the print sheet may be also generated by ink droplets ejected from the inkjet heads onto the print sheet. This airflow formed by the ejected droplets is called as self-generated airflow.

SUMMARY OF THE INVENTION

Here, airflow generated by plural nozzles neighboring along the primary sweeping direction may behave as a wall that blocks the airflow generated by print sheet feeding. This pseudo wall is called as an ink wall. If the ink wall is formed, the airflow along the secondary sweeping direction (=the feeding direction) generated by sheet feeding transmutes to airflow that flows along the ink wall and then flows around behind the ink wall.

By the way, each of inkjet heads in a line-type inkjet printer may includes nozzles aligned along the primary sweeping direction in two rows (nozzle rows). The two nozzle rows extend along the primary sweeping direction, and are parallel to each other in the secondary sweeping direction (=the feeding direction).

In such a line-type inkjet printer, if an ink wall is formed by ink ejection from nozzles in an upstream row of the two nozzle row, displacements of ink dots formed by ink droplets ejected from nozzles in a downstream row of the two nozzle row may occur by an airflow flowing around behind the ink wall. The ink dot displacements may degrade print quality.

For example, Japanese Patent Application Laid-Open No. 2010-173178 (Patent Document 1) discloses a line-type inkjet printer that may restrict ink dot displacements caused by self-generated airflow. The printer disclosed in the Patent Document 1 ejects ink droplets with various volumes, and restricts ink dot displacements by making ejecting speed higher for ink droplets as their volume is smaller (easier to be affected by the airflow).

However, in the printer disclosed in the Patent Document 1, ink dot displacement caused by the above-explained airflow flowing around behind the ink wall is not taken into account. Therefore, the printer disclosed in the Patent Document 1 cannot solve degradation of print quality due to the ink dot displacement caused by the above-explained airflow flowing around behind the ink wall.

An object of the present invention is to provide an inkjet printer that can restrict degradation of print quality.

An aspect of the present invention provides an inkjet printer that includes a plurality of nozzle rows aligned along a printing direction along which printing on a print medium is executed; and a controller configured to control ejection of ink droplets from the plurality of nozzle rows, wherein the controller executes printing on a print medium by ejecting ink droplets from the plurality of nozzle rows onto the print medium while moving the plurality of nozzle rows relatively to the print medium based on image data, the plurality of nozzle rows includes a pair of an upstream nozzle row and a downstream nozzle row, the upstream nozzle row being positioned just upstream from the downstream nozzle row along the printing direction, and the controller controls ejection of the ink droplets from the upstream nozzle row and the downstream nozzle row so that propulsive forces applied to ink droplets ejected from the downstream nozzle row are made larger, based on image data associated with the upstream nozzle row, than propulsive forces applied to ink droplets ejected from the upstream nozzle row.

According to the aspect, even when an ink wall is generated by ink droplets ejected from the upstream nozzle row and airflow flowing around behind the ink wall is further generated, the ink droplets ejected from the downstream nozzle row are hardly affected by the airflow because the propulsive forces applied to the ink droplets ejected from the downstream nozzle row are made larger, based on image data associated with the upstream nozzle row, than the propulsive forces applied to the ink droplets ejected from the upstream nozzle row. As a result, displacements of the ink droplets ejected from the downstream nozzle can be restricted and thereby degradation of print quality can be restricted.

It is preferable that the controller makes the propulsive forces applied to ink droplets ejected from the downstream nozzle row larger by executing at least one of (a) a control for setting drive voltage waveforms for ejecting the ink droplets from the upstream nozzle row and the downstream nozzle row so that ejection speed of ink droplets ejected from the downstream nozzle row is made faster than ejection speed of ink droplets ejected from the upstream nozzle row, (b) a control for setting for setting drive voltage magnitudes for ejecting the ink droplets from the upstream nozzle row and the downstream nozzle row so that ejection speed of ink droplets ejected from the downstream nozzle row is made faster than ejection speed of ink droplets ejected from the upstream nozzle row, and (c) a control for heating ink to be ejected as ink droplets ejected from the downstream nozzle so that ejection speed of the ink droplets ejected from the downstream nozzle row is made faster than ejection speed of ink droplets ejected from the upstream nozzle row.

According to this configuration, the propulsive forces applied to ink droplets ejected from the downstream nozzle row can be made larger with relative ease by at least one of the controls (a) to (c).

It is preferable that the image data are multiple-valued data for allocating ink droplets to be ejected to nozzles in the plurality of nozzle rows, the inkjet printer further comprises an image processing unit that converts the image data by reallocating ink droplets allocated to nozzles in the downstream nozzle row so as to decrease the number of nozzles to be used for ejection of the ink droplets and to increase the number of ink droplets to be sequentially ejected from each of the nozzles 14 to be used, and the controller controls ejection of ink droplets from the upstream nozzle row and the downstream nozzle row independently from each other based on the image data converted by the image processing unit.

According to this configuration, the image data are converted so that ink droplets are sequentially ejected from the nozzles. Therefore, displacements of ink dots made by the ink droplets ejected from the downstream nozzle row are restricted by the above-explained conversion of the image data. As a result, degradation of print quality can be further restricted.

It is preferable that the controller is configured to control ejection timings of ink droplets to be ejected from the downstream nozzle row according to ejection speeds of the ink droplets.

According to this configuration, displacements of ink dots made by the ink droplets ejected from the downstream nozzle row are restricted by the above-explained conversion of the image data. As a result, degradation of print quality can be further restricted.

It is preferable that the controller is configured to control ejection timing of ink droplets to be ejected from the downstream nozzle row according to a distance between the downstream nozzle row and the print medium.

According to this configuration, displacements of ink dots made by the ink droplets ejected from the downstream nozzle row are restricted by the above-explained conversion of the image data even when the distance changes (varies). As a result, degradation of print quality can be further restricted.

BRIEF DESCRIPTION OF THE DRAWINGS

FIG. 2A is an enlarged bottom view of the inkjet head showing a nozzle arrangement;

FIG. 2B is a plan view showing a desired arrangement of ink dots;

FIG. 2C is a plan view showing displacement of ink dots;

DESCRIPTION OF THE EMBODIMENTS

Embodiments will be explained with reference to the drawings hereinafter.

First Embodiment

An inkjet printer 1 according to a first embodiment includes plural inkjet heads 11. The inkjet heads 11 includes plural head blocks 12 that are aligned along a feeding direction (a secondary sweeping direction) of a print sheet P and along a perpendicular direction (a primary sweeping direction) to the feeding direction in a staggered manner. Each of the head blocks 12 is provided with two rows of nozzles 14 for ejecting ink droplets (a pair of nozzle rows). Along the feeding direction, one of the nozzle rows is located on an upstream side (an upstream nozzle row) and another of the nozzle rows is located on a downstream side (a downstream nozzle row). Namely, the upstream nozzle row is positioned just upstream from the downstream nozzle row. Ink droplets are ejected from the nozzles 14 onto a print sheet based on image data to form a printed image.

<Structural Configuration of Inkjet Printer 1>

Figure 1:
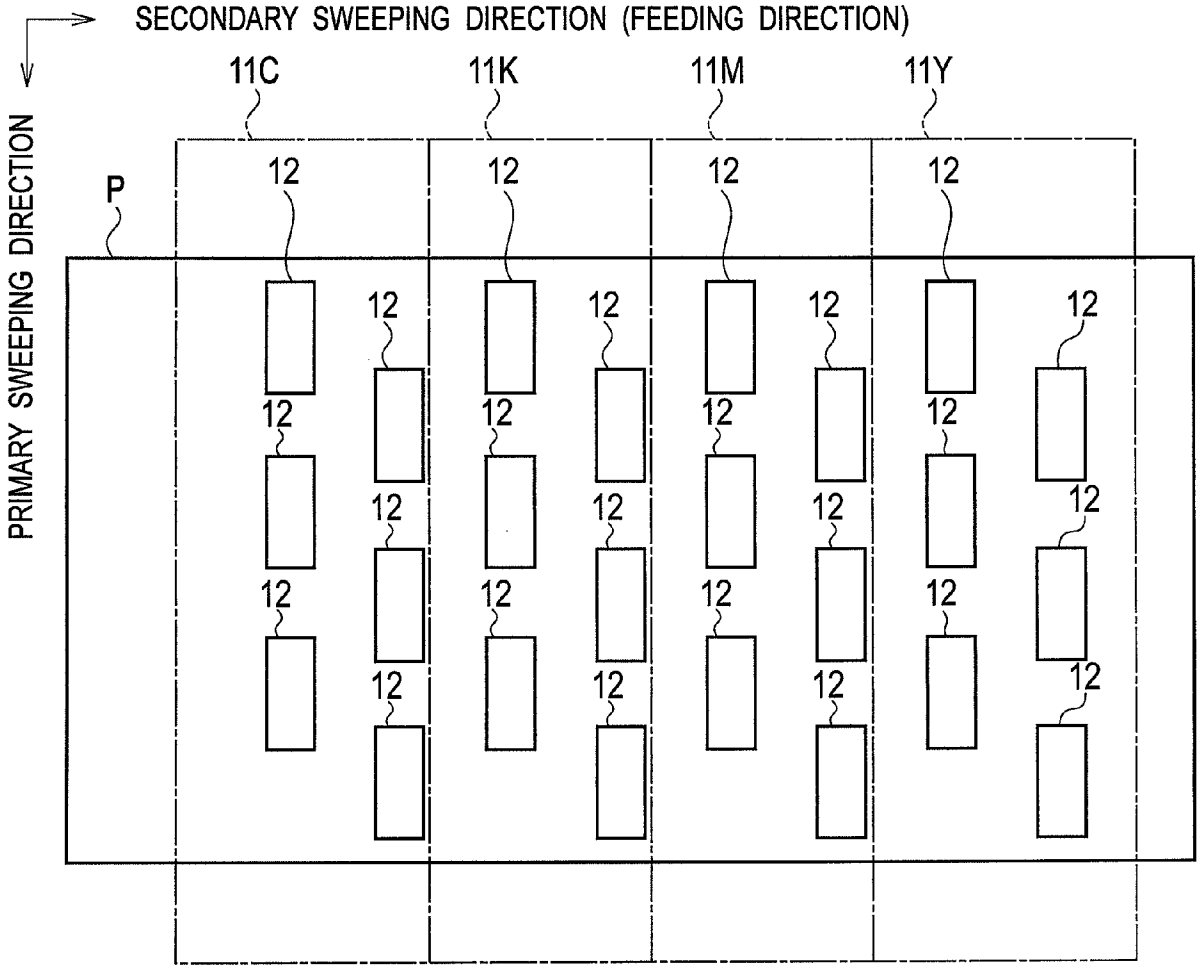
FIG. 1 is a plan view of inkjet heads included in an inkjet printer according to a first embodiment.

As shown in FIG. 1, the inkjet printer 1 includes line-type inkjet heads 11 (11C, 11K, 11M and 11Y), and the inkjet heads 11 are aligned along the feeding direction of a sheet paper P (secondary direction). Each of the inkjet heads 11 ejects ink droplets of cyan (C), black (K), magenta (M) and yellow (Y), respectively. Each of the inkjet heads 11 have identical configuration, and they will be referred with a suffix C, K, M and Y when they should be differentiated by their color.

While a print sheet P is being fed along the secondary sweeping direction just under the inkjet heads 11, ink droplets are ejected from the inkjet heads 11 onto the print sheet P for printing. Here, the secondary sweeping direction is a printing direction defined in Claims of the present application.

Each of the inkjet heads 11 includes six head blocks 12. The six head blocks 12 are arranged in a staggered manner. Specifically, the six head blocks are aligned along the primary sweeping direction in two rows. The head blocks 12 in one of the two rows are aligned at intervals, and the head blocks 12 in another of the two rows are also aligned at intervals. The centers of the head blocks 12 in the one of the two rows are positioned so as not to coincide with the centers of the head blocks 12 in the other of the two rows.

As shown in FIG. 2A, each of the head blocks 12 includes an upstream head 13A and a downstream head 13B. The downstream head 13B is located on a downstream side of the upstream head 13A along the secondary sweeping direction (=the deeding direction of a print sheet P). The upstream head 13A and the downstream head 13B have identical configuration, and each of them includes plural nozzles 14 in one row (nozzle row) along the primary sweeping direction.

In the nozzle row on the upstream head 13A (the upstream nozzle row) and the nozzle row on the downstream head 13B (the downstream nozzle row), the nozzles 14 are aligned along the primary sweeping direction at even intervals. The nozzles 14 on the upstream head 13A are shifted by half pitches to the nozzles 14 on the downstream head 13B. Therefore, this arrangement of the nozzles 14 can bring improvement of resolution along the primary sweeping direction as shown in FIG. 2B.

The upstream head 13A includes an ink chamber at its inside, and the ink chamber communicates with the nozzles 14 on the upstream head 13A. The downstream head 13B includes an ink chamber at its inside, and the ink chamber communicates with the nozzles 14 on the downstream head 13B. A piezoelectric element is disposed in each of the ink chamber. When drive voltage is applied to the piezoelectric element, ink droplets are ejected through the nozzles 14.

Figure 3:
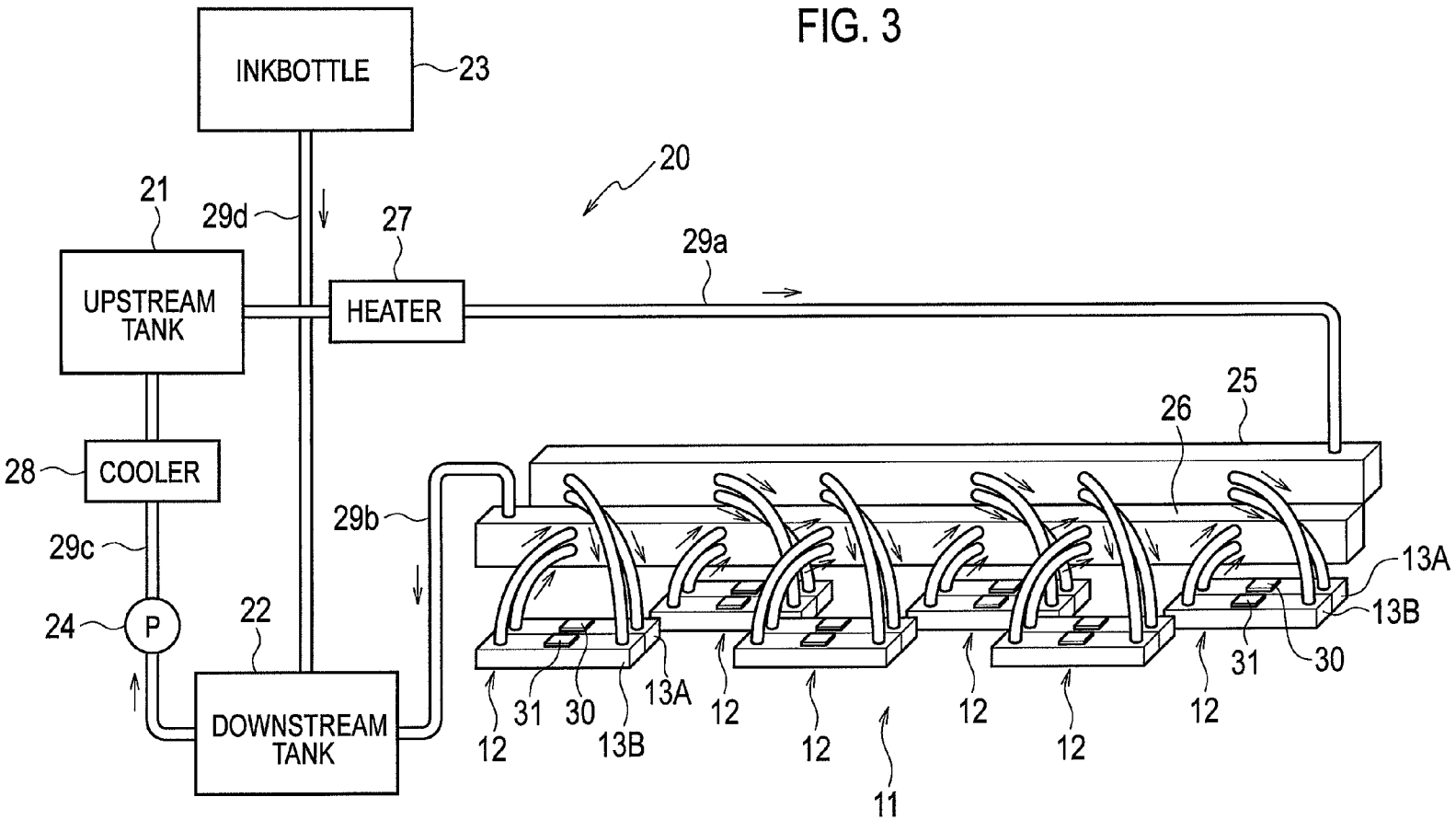
FIG. 3 is a schematic configuration diagram of the inkjet heads and ink circulation units in the inkjet printer.

As shown in FIG. 3, ink is supplied to the ink chambers in the upstream heads 13A and the downstream heads 13B by an ink circulation unit 20. Note that FIG. 3 shows configuration for a single inkjet head 11, so that other five inkjet heads 11 are not shown in FIG. 3. The ink circulation unit 20 supplies ink to the inkjet head(s) 11 while circulates the ink. The ink circulation unit 20 includes an upstream tank 21, a downstream tank 22, an inkbottle 23, a pump 24, a distributor 25, a collector 26, a heater 27, a cooler 28, and pipes 29*a* to 29*d*.

The upstream tank 21 accumulates ink sent from the downstream tank 22, and supplies the accumulated ink to the inkjet head 11. The downstream tank 22 accumulates ink that was not consumed through ink ejection by the inkjet head 11. In addition, the downstream tank 22 accumulates ink supplied from the inkbottle 23.

The inkbottle 23 accumulates ink to be used for printing in the inkjet printer 1. The inkbottle 23 supplies the ink to the downstream tank 22. The pump 24 sends ink from the downstream tank 22 to the upstream tank 21. The pump 24 is disposed on a pipe 29*c* connecting the downstream tank 22 with the upstream tank 21.

The distributor 25 distributes ink supplied from the upstream tank 21 through a pipe 29*a* to the upstream heads 13A and the downstream heads 13*b* of the head blocks 12. The collector 26 collects ink that was not consumed through ink ejection by the head blocks 12. The ink collected into the collector 26 flows to the downstream tank 22 through a pipe 29*b*.

The heater 27 heats ink that is being recirculated. The heater 27 is disposed on the pipe 29*a* connecting the upstream tank 21 with the distributor 25. The cooler 28 cools ink that is being recirculated. The cooler 28 is disposed on a pipe 29*c* connecting the downstream tank 22 with the upstream tank 21. A pipe 29*d* connects the inkbottle 23 with the downstream tank 22.

As shown in FIG. 3, an upstream thermometer 30 for detecting ink temperature is provided at each of the upstream head 13A of the inkjet head 11. In addition, a downstream thermometer 31 for detecting ink temperature is provided at each of the downstream head 13B of the inkjet head 11. Ink temperature is regulated by the heater 27 and the cooler 28 based on the detection results of the thermometer 30 and 31.

Next, airflow caused by ink ejection from the inkjet head(s) 11 will be explained.

Figure 4:
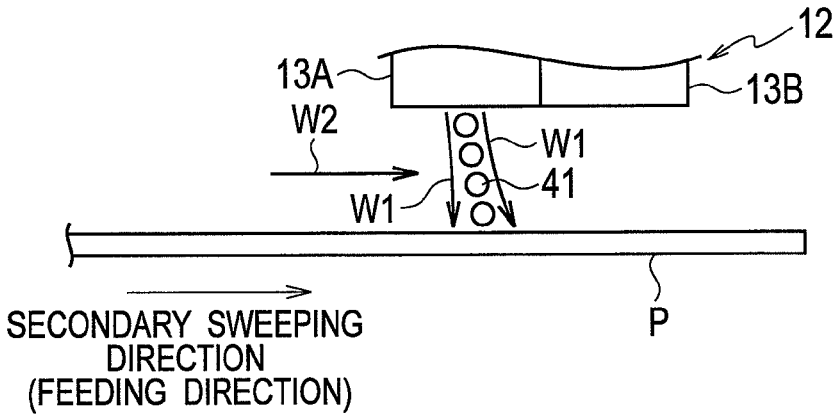
FIG. 4 is an explanatory diagram of self-generated airflow.

As shown in FIG. 4, self-generated airflow W1 is generated by ejection of ink droplets 41 from the head block(s) 12 of the inkjet head 11. The self-generated airflow W1 is airflow flowing from the head block 12 toward a print paper P. In addition, airflow W2 is generated in the feeding direction (secondary sweeping direction) by feeding of the print sheet P. When ink droplets 41 are sequentially ejected from the nozzles 14 neighboring in the nozzle row, the self-generated airflow W1 generated by the sequentially ejected ink droplets 41 may form an ink wall 42 (see FIG. 5) that blocks the airflow W2.

Figure 5:
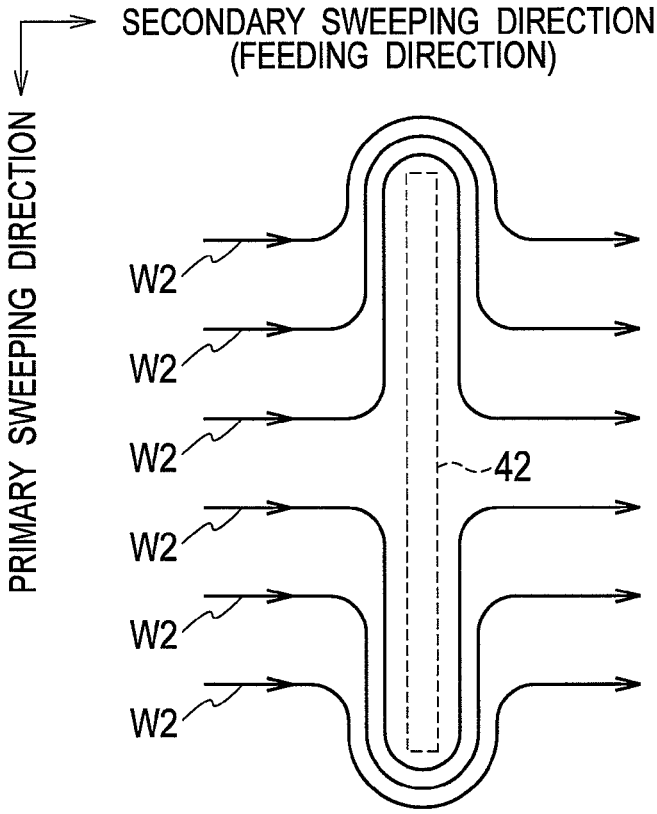
FIG. 5 is an explanatory diagram of airflow near an ink wall.

As shown in FIG. 5, when the ink wall 42 is formed, the airflow W2 flows along the ink wall 42, and then flows around behind the ink wall 42. Namely, the airflow W2 flows to a downstream side of the ink wall 42. As a result, the airflow W2 flows from both sides of the ink wall 42 along the primary sweeping direction to the center of the ink wall 42 at the downstream side of the ink wall 42. When the ink wall 42 is formed by ejection of ink droplets 41 from the nozzle row on the upstream head 13A, trajectories of ink droplets ejected from the nozzle row on the downstream head 13B are subject to be bent to the center by the airflow W2 on the downstream side of the ink wall 42 shown in FIG. 5.

When the trajectories of ink droplets ejected from the nozzles 14 on the downstream head 13B are bent, by the above-explained airflow W2, as shown by directions X1 and X2 shown in FIG. 2A, ink dot displacements may occur as shown in FIG. 2C. The ink dot displacements as shown in FIG. 2C may brings poorer print quality than that brought by a desired arrangement of ink dots shown in FIG. 2B. In FIGS. 2B and 2C, solid black circles indicate ink dots made by ink droplets ejected from the nozzles 14 on the upstream head 13A, and hatched circles indicate ink dots made by ink droplets ejected from the nozzles 14 on the downstream head 13B.

Figure 6A:
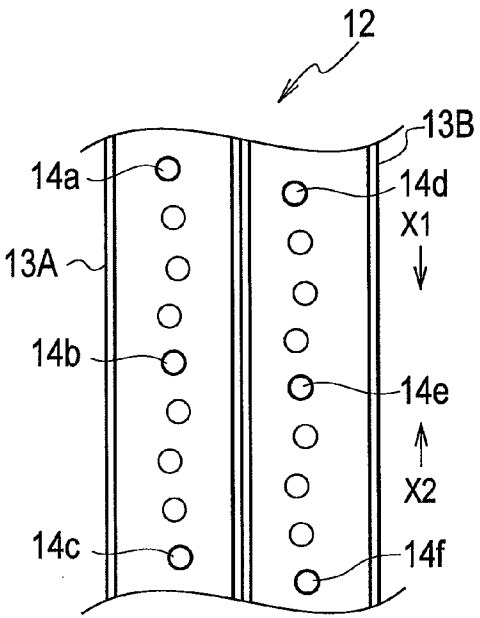
FIG. 6A is an enlarged bottom view of the inkjet head showing its nozzles that is used in an experiment in which ink dot displacements are measured.
Figure 6B:
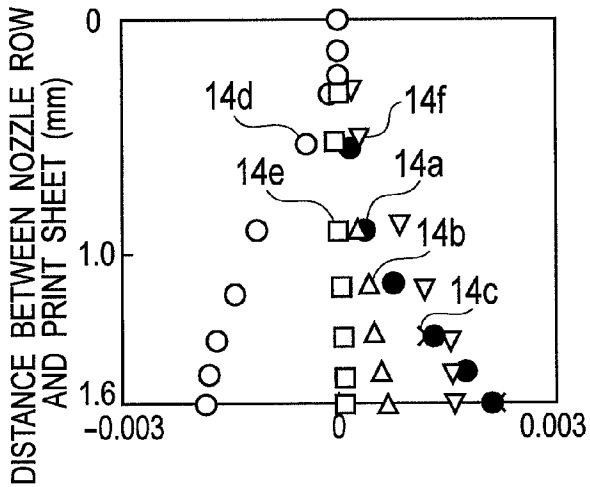
FIG. 6B is a chart showing the ink dot displacements along a primary sweeping direction measured in the experiment.
Figure 6C:
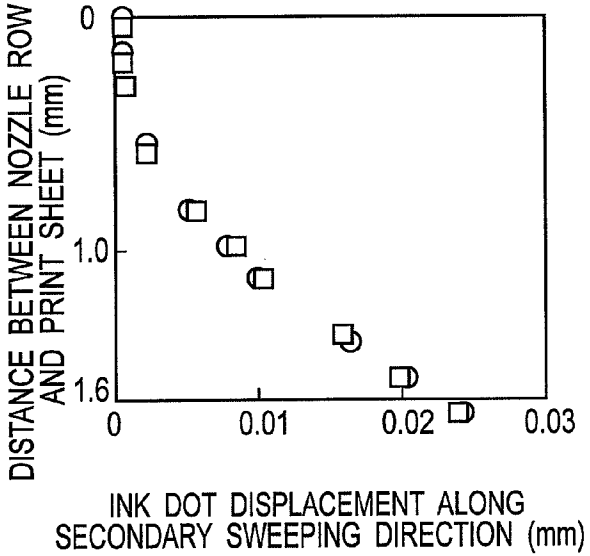
FIG. 6C is a chart showing the ink dot displacements along a secondary sweeping direction measured in the experiment.

FIGS. 6A to 6C relates to an experiment for measuring ink dot displacement. In the experiment, ink droplets are ejected from nozzles 14 shown in FIG. 6A (i.e. all nozzles 14 between a nozzle 14*a* to a nozzle 14*c* on the upstream head 13A and all nozzles 14 between a nozzle 14*d* to a nozzle 14*f* on the downstream head 13B). Ejection speeds of all ink droplets ejected from the nozzles 14 on the upstream head 13A and the downstream head 13B are set identical in the experiment.

Displacements (along the primary sweeping direction) of ink dots made by ink droplets ejected from the nozzles 14*a* to 14*f* are indicated by the identical reference numerals in FIG. 6B. Namely, black circles indicate displacements of ink dots made by ink droplets ejected from the nozzles 14*a*. White upper-tipped triangles indicate displacements of ink dots made by ink droplets ejected from the nozzles 14*b*. X-marks indicate displacements of ink dots made by ink droplets ejected from the nozzles 14*c*. White circles indicate displacements of ink dots made by ink droplets ejected from the nozzles 14*d*. White squares indicate displacements of ink dots made by ink droplets ejected from the nozzles 14*e*. White lower-tipped triangles indicate displacements of ink dots made by ink droplets ejected from the nozzles 14*f*. Note that some marks are not visible because they are hidden by other marks (e.g. some of the X-marks are hidden by the black circles).

Averaged displacements (along the secondary sweeping direction) of ink dots made by ink droplets ejected from the nozzles 14*a* to 14*f* are indicated in FIG. 6C. Namely, white circles indicate averaged displacements of ink dots made by ink droplets ejected from the nozzles 14*a* to 14*c* on the upstream head 13A. White squares indicate averaged displacements of ink dots made by ink droplets ejected from the nozzles 14*d* to 14*f* on the downstream head 13B. Note that the ink dot displacements are measured with various distances between a print sheet P and the nozzle rows (ejection plane) as shown by a vertical axis of each chart shown in FIGS. 6B and 6C. In addition, the ink dot displacements are measured under a condition where the ink wall 42 is being formed continuously and stably.

As shown in FIG. 6B, displacement (along the primary sweeping direction) of ink dots made by ink droplets ejected from the nozzles 14*d* and 14*f* on the downstream head 13B are large. On the other hand, as shown in FIG. 6C, averaged displacements (along the secondary sweeping direction) of ink dots made by ink droplets ejected from the nozzles 14*d* to 14*f* on the downstream head 13B are not so different from averaged displacements (along the secondary sweeping direction) of ink dots made by ink droplets ejected from the nozzles 14*a* to 14*c* on the upstream head 13A, respectively.

Therefore, it can be assumed that ink droplets are subject to land at positions that are distant from their desired (target) landing positions along the directions X1 and X2 due to affection by the airflow flowing around behind the ink wall 42.

According to the present embodiment, ejection of ink droplets from the nozzles 14 (nozzle rows) on the downstream head 13B is controlled so that propulsive forces applied to the ink droplets ejected from the nozzles 14 on the downstream head 13B are made larger, based on image data associated with the nozzles 14 (nozzle rows) on the upstream head 13A, than propulsive forces applied to ink droplets ejected from the nozzles 14 on the upstream head 13A. Specifically, ejection of ink droplets from the nozzles 14 on the downstream head 13B and ejection of ink droplets from the nozzles 14 on the upstream head 13A are controlled independently from each other. In a case where the ink wall 42 may be formed by ink droplets ejected from the nozzles 14 (nozzle rows) on the upstream head 13A, displacements of ink dots made by ink droplets ejected from the nozzles 14 (nozzle rows) on the downstream head 13B are restricted by increasing the propulsive forces applied to the ink droplets ejected from the nozzles 14 (nozzle rows) on the downstream head 13B.

<Functional Configuration of Inkjet Printer 1>

Figure 7:
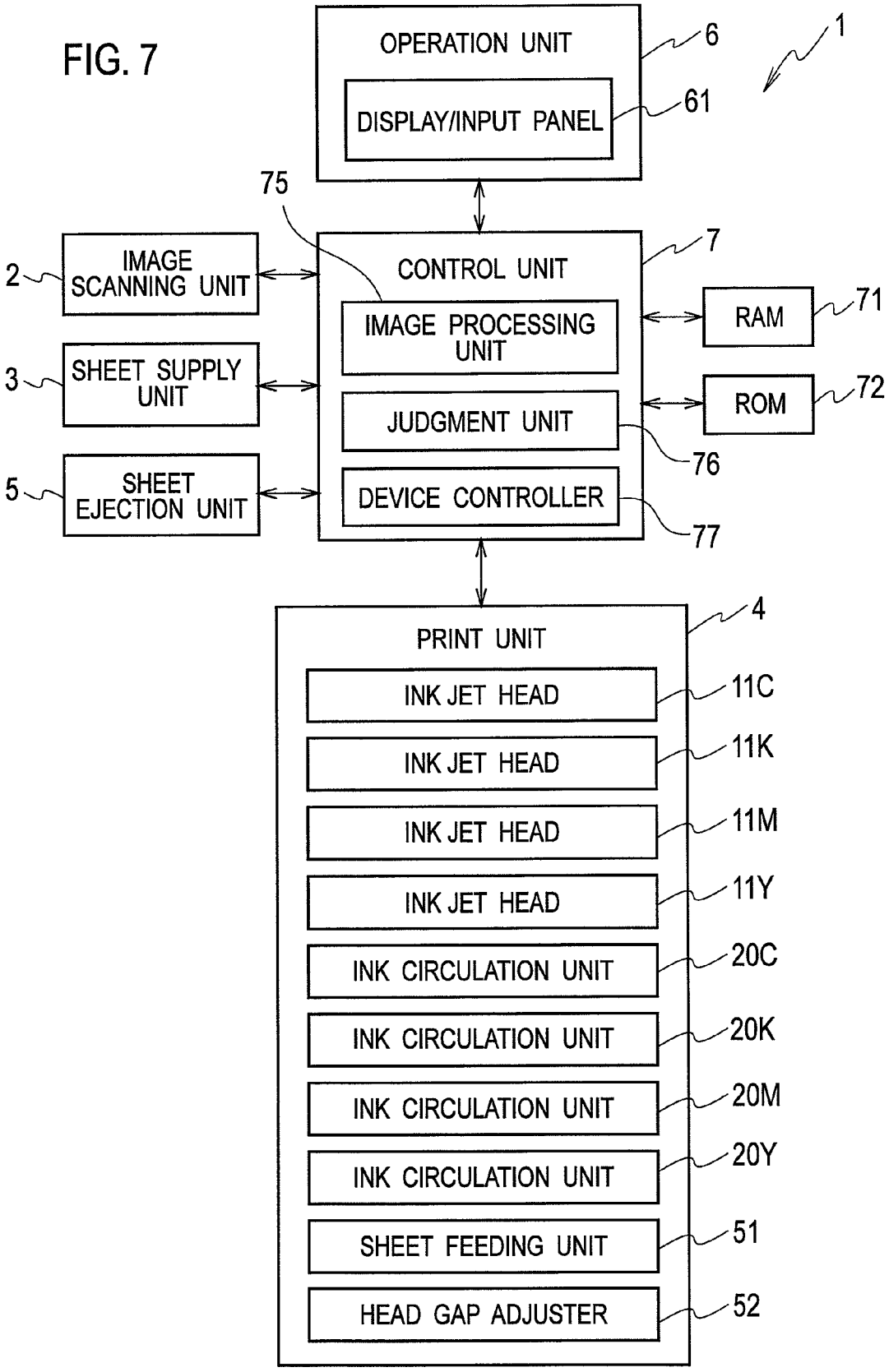
FIG. 7 is a block diagram showing functional configuration of the inkjet printer.

As shown in FIG. 7, the inkjet printer 1 includes an image scanning unit 2, a sheet supply unit, a print unit 4, a sheet ejection unit 5, an operation unit 6, a control unit 7, a RAM 71, and a ROM 72.

The image scanning unit 2 is disposed at an upper portion of the inkjet printer 1. The image scanning unit 2 scans an original document to be copied (printed) by is device such as a scanner, and then generates image data. The sheet supply unit 3 picks up print sheets (print media) P stacked on a sheet supply tray (not shown) sheet by sheet, and then feeds the print sheets P to the print unit 4 while compensating obliquely feeding.

The print unit 4 includes the above-explained inkjet heads 11 (11C to 11Y) and the ink circulation units 20 (20C to 20Y). The print unit 4 further includes a sheet feeding unit 51 that feeds the print sheets P supplied from the sheet supply unit 3 to the inkjet heads 11. The print unit 4 prints images by ejecting ink droplets onto a print sheet P while feeding the print sheet P by the sheet feeding unit 51. The sheet ejection unit 5 print sheets P printed by the print unit.

The operation unit 6 is also disposed at an upper portion of the inkjet printer 1. The operation unit 6 includes a display/input panel 61 and various operational buttons (not shown) such as a start button for starting operations such as printing, a stop button for stopping the operation and a ten-key pad to which the number of sheets to be printed and so on. The operation unit 6 supplies operational signals generated based on user's operations to the control unit 7. The display/input panel 61 includes a resistive or capacitive transmissive touchscreen disposed on its front, and an LCD panel disposed behind the touchscreen. A user can touch a surface of the touch screen directly while viewing an image displayed on the LCD panel in order to input various instructions such as print settings.

The RAM 71 is constituted by non-volatile semiconductors or the like, and can stores data needed for execution of various processes by the control unit 7. The ROM 72 is constituted by volatile semiconductors or the like, and stores control programs executed by the control unit 7. The control unit 7 includes, in view of its functions, an image processing unit 75, a judgment unit 76, and a device controller 77. The control unit 7 functions as a controller defined in Claims of the present application.

The image processing unit 75 executes a halftone process to the image data generated by the image scanning unit 2 to generate multiple-valued drop data (e.g. drop values [0 to 5]) that is image data having a print format optimized for printing by the inkjet heads 11. Note that, in a case where printing is to be done based on image data input from an external device (terminal) to the inkjet printer 1, the image processing unit 75 generates drop data based on the input image data.

The judgment unit 76 judges whether or not ejection of ink droplets from the upstream nozzle row(s) of the inkjet heads 11 affects landing positions of ink droplets from the downstream nozzle row(s) of the inkjet heads 11. Specifically, the judgment unit 76 judges, based on the drop data, whether or not an ink wall is to be generated by ejection of ink droplets from the upstream nozzle row(s) of the inkjet heads 11.

The device controller 77 controls the image scanning unit 2, the sheet supply unit 3, the print unit 4, the sheet ejection unit 5, and the operation unit 6. When it is judged, by the judgment unit 76, that an ink wall is to be generated by ejection of ink droplets from the upstream nozzle row(s) of the inkjet heads 11, the device controller 77 controls the upstream nozzles 14 of the inkjet heads 11 and the downstream nozzles 14 of the inkjet heads 11 independently from each other so as to making propulsive forces applied to ink droplets ejected from the downstream nozzles 14 larger than propulsive forces applied to ink droplets ejected from the upstream nozzles 14. Specifically, the device controller 77 individually controls the nozzles 14 on the upstream head 13A, and also individually controls the nozzles 14 on the downstream head 13B.

<Processes Done by Inkjet Printer 1>

Figure 8:
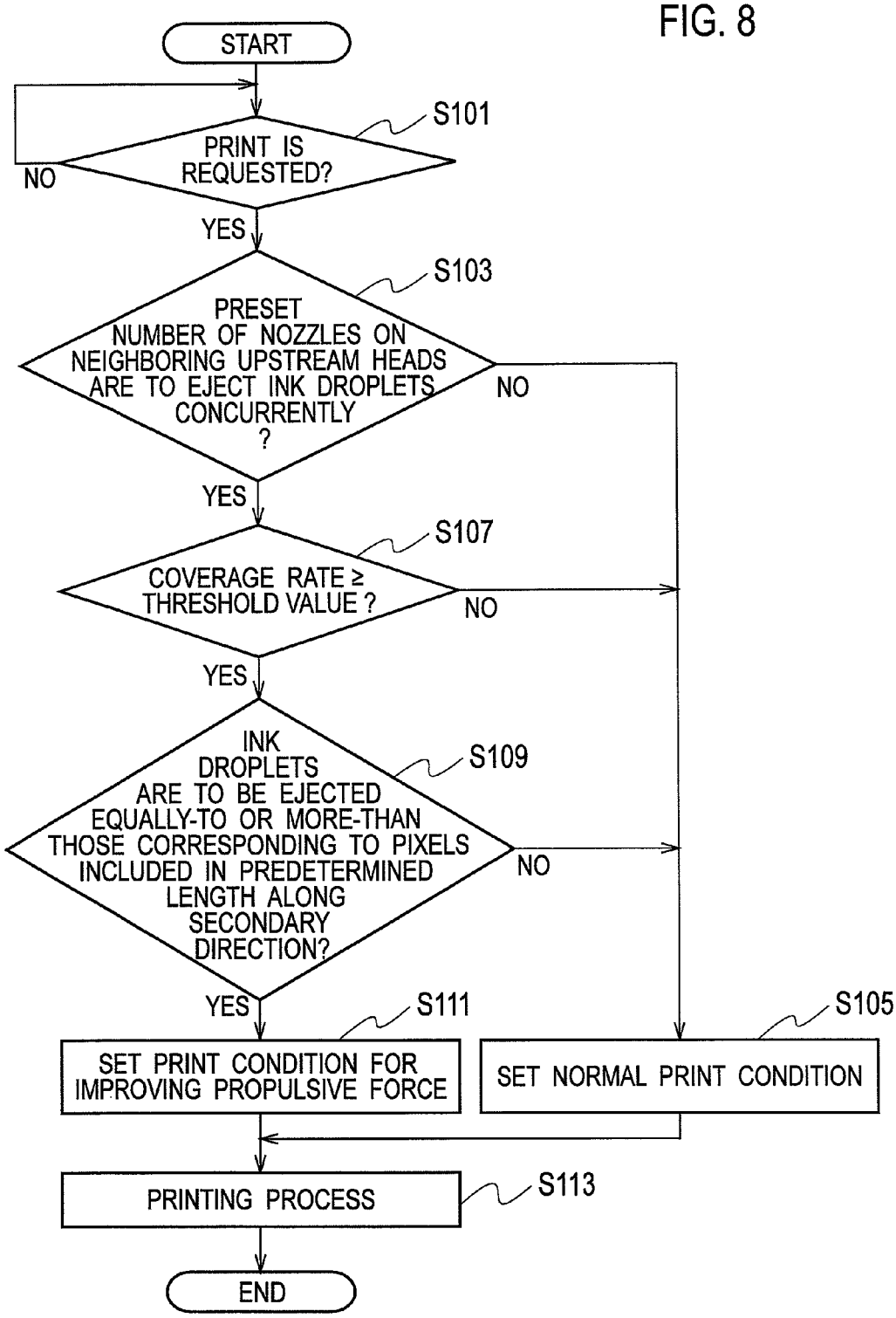
FIG. 8 is a flowchart showing processes done by the inkjet printer.

Processes done by Inkjet Printer 1 according to the present embodiment will be explained with reference to a flowchart shown in FIG. 8.

The control unit 7 determines whether or not a print request is made (step S101). Specifically, the control unit 7 determines whether or not to receive, from the operation unit 6, an operational signal for requesting printing generated through a user's operation. When a print request is made (Yes in step S101), the device controller 77 controls the image scanning unit 2 to retrieve image data of an original document. Then, the image processing unit 75 generates drop data based on the image data generated by the image scanning unit 2 (converts the image data retrieved by the image scanning unit 2 to the drop data).

The judgment unit 76 judges, based on the drop data, whether or not the preset number of nozzles 14 (e.g. 60 nozzles) on the neighboring upstream heads 13A are to eject ink droplets concurrently (step S103).

When it is judged that the preset number of nozzles 14 on the neighboring upstream heads 13A are not to eject ink droplets concurrently (No in Step S103), the device controller 77 set a normal print condition (step S105). Specifically, the device controller 77 controls ejection of ink droplets from nozzles 14 on the upstream heads 13A and the downstream heads 13B so that propulsive forces applied to the ink droplets from nozzles 14 on the upstream heads 13A and the downstream heads 13B are equal (without intentionally differentiating them).

On the other hand, when it is judged that the preset number of nozzles 14 on the neighboring upstream heads 13A are to eject ink droplets concurrently (Yes in Step S103), the judgment unit 76 judges whether or not coverage rate is equal-to or more-than a threshold value (e.g. 80%) based on the drop data (step S107).

When it is judged that coverage rate is equal-to or more-than the threshold value (Yes in step S107), the judgment unit 76 judges, based on the drop data, whether or not ink droplets are to be ejected equally-to or more-than those corresponding to pixels included in a predetermined length (e.g. 10 mm) along the secondary sweeping direction (printing direction) (step S109). Specifically, when the judgment conditions of steps S103, S107 and S109 are all satisfied, it can be assumed that the ink wall(s) 42 is formed by ink droplets ejected from the upstream head(s) 13A.

As explained above, the airflow W2 is generated along the feeding direction (printing direction) along with feeding of a sheet paper(s) P, and the airflow W2 is blocked by the ink wall 42 as shown in FIG. 5. Therefore, the airflow W2 transmutes to airflow that flows along the ink wall 42 and then flows around behind the ink wall 42. As a result, ink droplets ejected from the nozzles 14 on the downstream head(s) 13B are affected by the airflow W2 so as to be pushed in the directions X1 and X2.

In the present embodiment, when all judgment conditions of steps S103, S107 and S109 are not satisfied, it can be assumed that the ink wall 42 is not formed and landing positions of ink droplets ejected from the downstream head(s) 13B are not so affected by airflow. Therefore, when all judgment conditions of steps S103, S107 and S109 are not satisfied (No in any one of steps S103, S107 and S109), the device controller 77 set a normal print condition (step S105). Each of the judgment in steps S103, S107 and S109 is made for each ink color. An after-explained process in step S111 is also made for each ink color.

On the other hand, when it is judged that ink droplets are to be ejected equally-to or more-than those corresponding to pixels included in the predetermined length along the secondary sweeping direction (Yes in step S109), the device controller 77 set a print condition for improving propulsive forces applied to ink droplets to be ejected from the nozzles 14 on the downstream head(s) 13B (step S111). Specifically, the device controller 77 controls drive voltage waveform supplied to the downstream head(s) 13B for ejecting ink droplets from the nozzles 14 on the downstream head(s) 13B so that propulsive forces applied to ink droplets ejected from the nozzles 14 on the downstream head(s) 13B are made larger than propulsive forces applied to ink droplets ejected from the nozzles 14 on the upstream head(s) 13A.

Figure 9A:
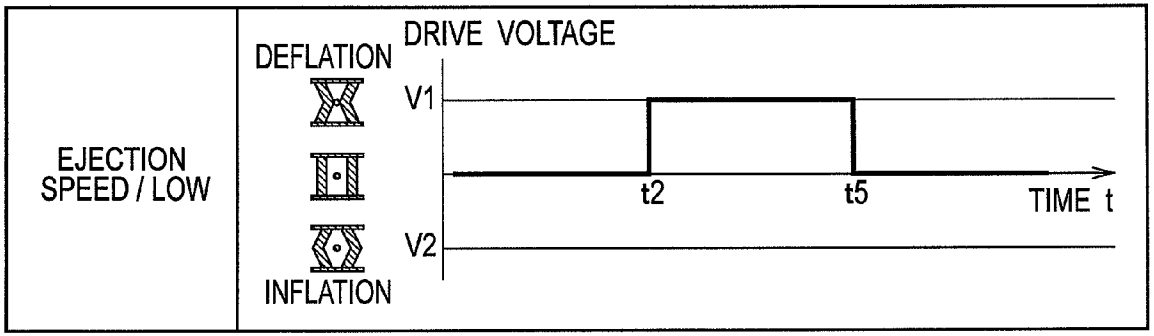
FIG. 9A is a chart showing drive voltage waveform for low ejection speed of ink droplets.
Figure 9B:
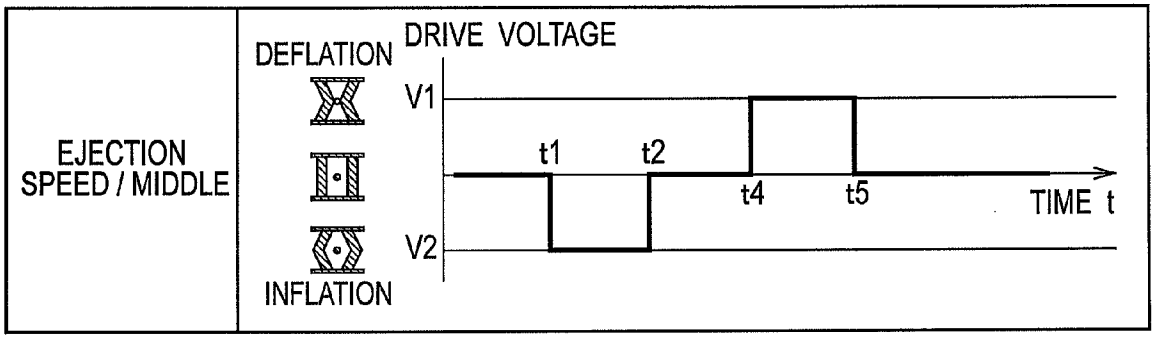
FIG. 9B is a chart showing drive voltage waveform for middle ejection speed of ink droplets.
Figure 9C:
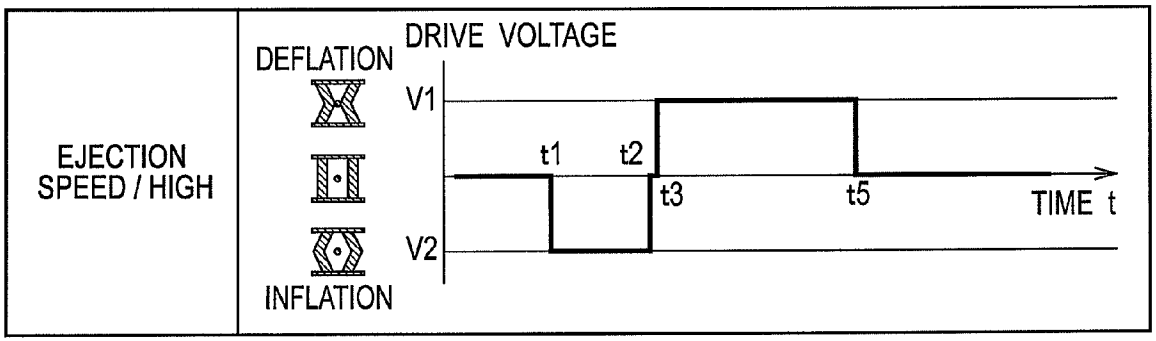
FIG. 9C is a chart showing drive voltage waveform for high ejection speed of ink droplets.

FIGS. 9A to 9C show drive voltage waveforms supplied to the downstream head(s) 13B or the upstream head(s) 13A. As shown in FIG. 9A, when ejecting ink droplets at low ejection speed, the device controller 77 applies positive voltage pulse V1 for deflating the ink chambers to the head(s) 13A or 13B from time t2 to time t5.

As shown in FIG. 9B, when ejecting ink droplets at middle ejection speed, the device controller 77 applies negative voltage pulse V2 for inflating the ink chambers to the head(s) 13A or 13B from time t1 to time t2 in order to increase a propulsive force for a shot of a single ink droplet, and then applies positive voltage pulse V1 for deflating the ink chambers to the head(s) 13A or 13B from time t4 to time t5 in order to eject the single ink droplet out from the nozzle 14.

As shown in FIG. 9C, when ejecting ink droplets at high ejection speed, the device controller 77 applies negative voltage pulse V2 for inflating the ink chambers to the head(s) 13A or 13B from time t1 to time t2 in order to increase a propulsive force for a shot of a single ink droplet, and then applies positive voltage pulse V1 for deflating the ink chambers to the head(s) 13A or 13B from time t3 to time t5 in order to eject the single ink droplet out from the nozzle 14. Here, the time t3 is earlier than time t4, i.e. duration time from t3 to t5 is longer than duration time from t4 to t5. Therefore, the single droplet can receive a larger propulsive force than that in a case show in FIG. 9B, so that the single droplet is ejected at high speed.

In these manners, the device controller 77 can control ejection speed of ink droplets by changing drive voltage waveforms so that ejection speed of ink droplets from the downstream head(s) 13B is made faster than that of ink droplets from the upstream head(s) 13A. Note that FIGS. 9A to 9C indicates a case where only ejection speed of an ink droplet is took into account and ejection volume of an ink droplet is not took into account. However, ejection volume may be also controlled in order to improve print quality as well as ejection speed.

For example, as the print condition set in step S111, the device controller 77 applies a drive voltage waveform for middle speed shown in FIG. 9B to the downstream head(s) 13B, and applies a drive voltage waveform for low speed shown in FIG. 9A to the upstream head(s) 13A.

Note that, as the print condition set in step S111, the device controller 77 may apply a drive voltage waveform for middle speed shown in FIG. 9B to some of the downstream heads 13B that are to be affected by the ink wall 42, and apply a drive voltage waveform for low speed shown in FIG. 9A to others of the downstream heads 13B that are to be affected by the ink wall 42 and the upstream head(s) 13A. Namely, affection by the ink wall 42 is judged for each nozzle 14, and then ejection of ink droplets is controlled for each nozzle 14 based on the judgment.

As explained above, the device controller 77 sets drive voltage waveform to be supplied to the downstream head(s) 13B for ejecting ink droplets from the nozzles 14 on the downstream head(s) 13B so that propulsive forces applied to ink droplets ejected from the nozzles 14 on the downstream head(s) 13B are made larger than propulsive forces applied to ink droplets ejected from the nozzles 14 on the upstream head(s) 13A.

After the process in step S105 or S111, the device controller 77 executes a printing process based on the print condition set in step S105 or S111 (step S113). When the printing process is started, the device controller 77 drives the pump 24 of the ink circulation unit(s) 20 to circulate ink. Here, it is judged that ink temperature detected by the thermometer 30 and 31 does not stay within an adequate temperature range, the device controller 77 keeps the ink temperature within the adequate temperature range by using the heater 27 and the cooler 28 while circulating ink. In addition, the device controller 77 controls the sheet supply unit 3 to supply a print paper(s) P to the print unit 4, and ejects ink droplets from the inkjet heads 11 based on the drop data while feeding the print paper(s) P.

When the print condition for improving propulsive forces is set in step S111, the device controller 77 controls the drive voltage waveforms applied to the upstream head 13A and the downstream head 13B according to the print condition. Here, the device controller 77 controls ejection timings of ink droplets to be ejected from the nozzles 14 on the downstream head 13B according to ejection speeds of the ink droplets to be ejected from the nozzles 14 on the downstream head 13B. Specifically, the device controller 77 delays the ejection timings of ink droplets to be ejected from the nozzles 14 on the downstream head(s) 13B to compensate for the ejection speed made faster so that the ink droplets land at their desired positions.

Even if the ejection speed of ink droplets ejected from the nozzles 14 on the downstream head 13B is differentiated from the ejection speed of ink droplets ejected from the nozzles 14 on the upstream head 13A, the ink droplets can land at their desired positions.

According to the inkjet printer according to the present embodiment, when it is judged that the ink wall(s) 42 is formed by ejection of ink droplets from the nozzles 14 on the upstream head(s) 13A, the ejection speed of (propulsive forces applied to) ink droplets ejected from nozzles 14 on the downstream head(s) 13B is made faster (are made larger) than the ejection speed of (propulsive forces applied to) ink droplets ejected from nozzles 14 on the upstream head(s) 13A. Therefore, displacements of ink droplets ejected from the nozzles 14 on the downstream head(s) 13B can be restricted and thereby degradation of print quality can be restricted.

In the present embodiment, the drive voltage waveforms applied for ejecting ink droplets from the nozzles 14 on the downstream head(s) 13B is controlled so that propulsive forces applied to ink droplets ejected from the nozzles 14 on the downstream head(s) 13B are made larger than propulsive forces applied to ink droplets ejected from the nozzles 14 on the upstream head(s) 13A. However, drive voltage magnitude applied for ejecting ink droplets from the nozzles 14 on the downstream head(s) 13B may be controlled so that propulsive forces applied to ink droplets ejected from the nozzles 14 on the downstream head(s) 13B are made larger than propulsive forces applied to ink droplets ejected from the nozzles 14 on the upstream head(s) 13A.

In this case, when drive voltage magnitude applied for ejecting ink droplets from the nozzles 14 on the upstream head(s) 13A is V1 (V), drive voltage magnitude applied for ejecting ink droplets from the nozzles 14 on the downstream head(s) 13B may be [V1×1.2] (V). The print condition may be set in step S111 as explained above. According to this print condition, propulsive forces applied to ink droplets ejected from the nozzles 14 on the downstream head(s) 13B can be made larger, and thereby the ejection speed of the ink droplets ejected from the nozzles 14 on the downstream head(s) 13B is made faster than ink droplets ejected from the nozzles 14 on the upstream head(s) 13A.

In addition, the above control(s) is not limited to be done for each nozzle row, but may be done for each nozzle. Further, if the inkjet printer 1 includes a head gap adjuster 52 that can adjust a head gap in order to improving print quality (e.g. according to thickness of a print paper P) as shown in FIG. 7, the device controller 77 may control ejection timings according to the head gap. A "head gap" is a distance between an ejection plane of the inkjet head 11 and (a surface of) a print sheet P. Since it takes longer time for an ink droplet to land onto a print sheet P as a head gap becomes larger, the device controller 77 may set the ejection timings earlier to compensate for the larger head gap. Note that the head gap adjuster 52 is controlled by the device controller 77 to adjust a head gap so that the adjusted head gap can be confirmed by the device controller 77.

Second Embodiment

In an inkjet printer 1 according to a second embodiment, propulsive forces applied to ink droplets are increased by heating ink to be ejected from the nozzles 14 on the downstream head(s) 13B as the ink droplets. Note that components in the present embodiment that are identical or similar to those in the above-explained first embodiment are indicated by identical reference numerals, so that redundant explanations for the identical or similar components will be omitted hereinafter.

Figure 10:
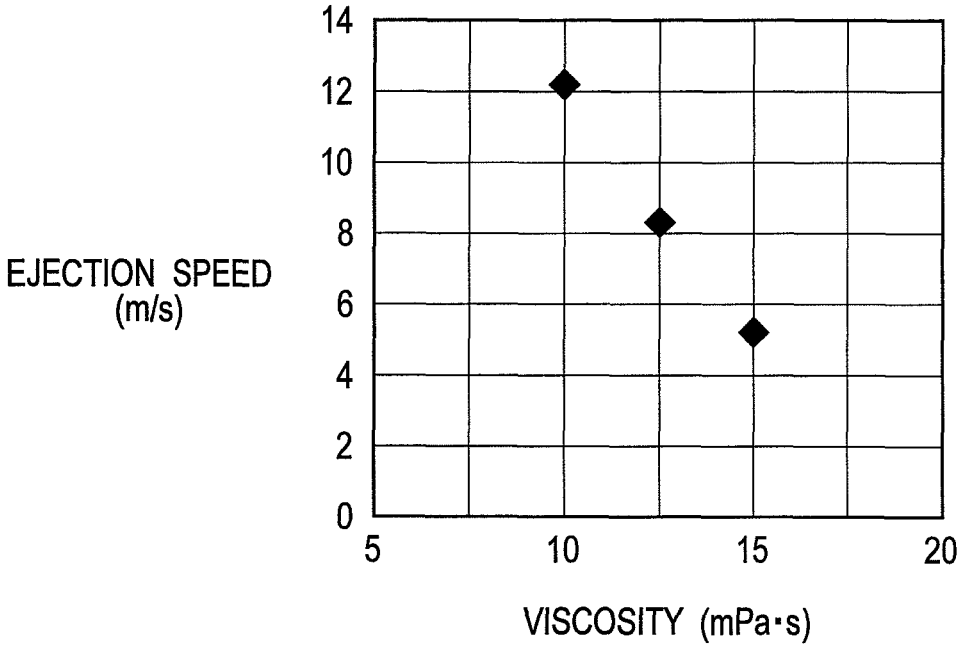
FIG. 10 is a chart showing relation between ink viscosity and ejection speed.
Figure 11:
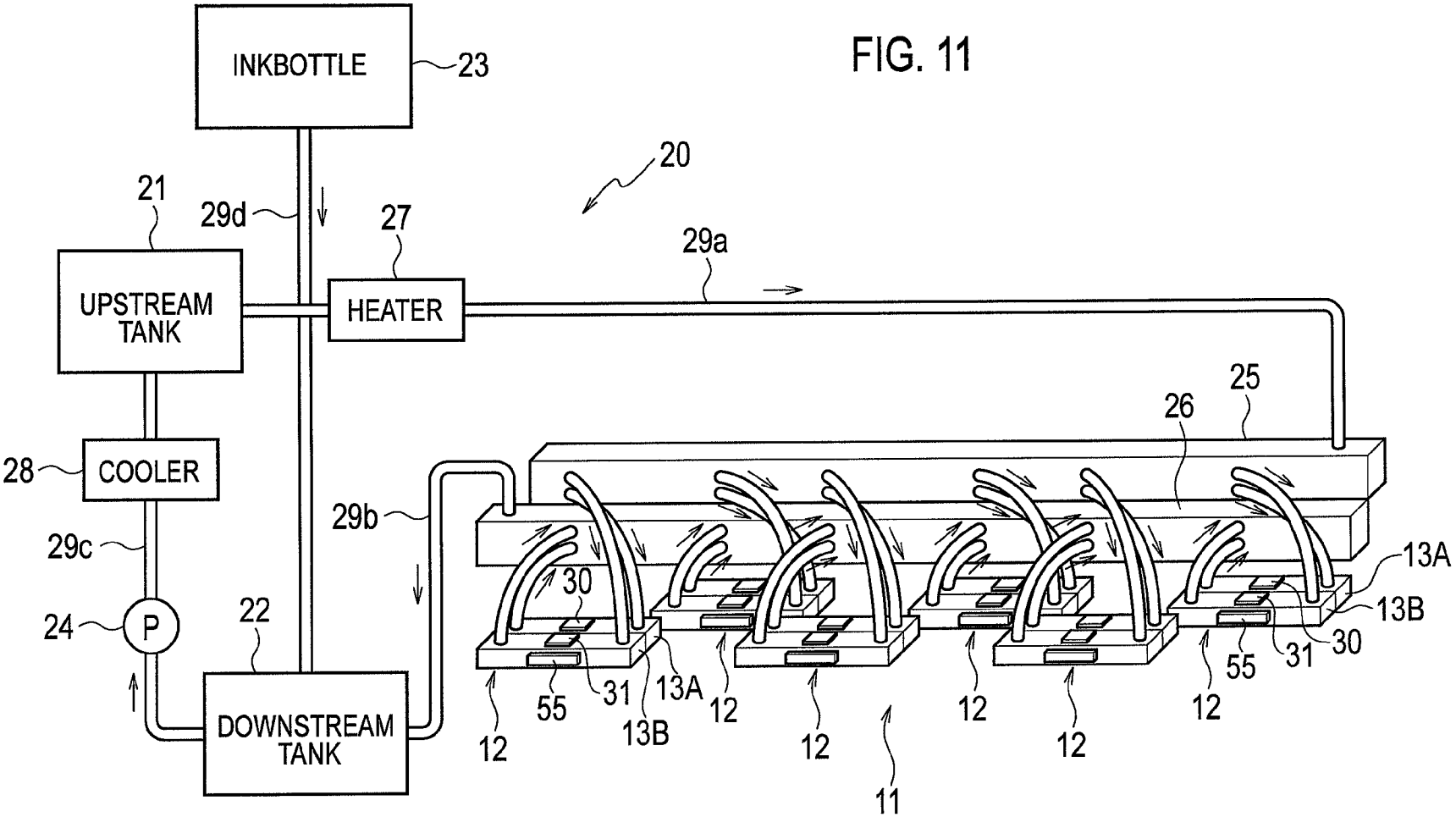
FIG. 11 is a schematic configuration diagram of inkjet heads and ink circulation units in an inkjet printer according to a second embodiment.

As ink temperature becomes higher, ink viscosity becomes smaller. In addition, as ink viscosity becomes smaller, ejection speed becomes faster as shown in FIG. 10. In the present embodiment, propulsive forces applied to ink droplets are increased by heating ink to increase ejection speed of ink droplets.

In the inkjet printer 1 according to the present embodiment, each of the downstream heads 13B is provided with an ink heater 55 for heating ink in the ink chamber to reduce ink viscosity.

When it is judged, by the judgment unit 76, that the ink wall 42 is to be generated by ejection of ink droplets from the nozzles 14 on the upstream head(s) 13A, the device controller 77 controls the ink heaters 55 so that ink temperature in the ink chambers of the downstream head(s) 13B is made higher than that in the ink chambers of the upstream head(s) 13A. As a result, ejection speed of ink droplets ejected from the nozzles 14 on the downstream head(s) 13B becomes faster than ejection speed of ink droplets ejected from the nozzles 14 on the upstream head(s) 13A. Here, the device controller 77 delays ejection timings of ink droplets to be ejected from the nozzles 14 on the downstream head(s) 13B to compensate for the ejection speed made faster so that the ink droplets land at their desired positions.

According to the present embodiment, in a case where the ink wall 42 may be formed by ink droplets ejected from the nozzles 14 on the upstream head 13A, displacements of ink dots made by ink droplets ejected from the nozzles 14 on the downstream head 13B are restricted by heating ink in the ink chamber of the downstream head 13B. Note that, if the inkjet printer 1 according to the present embodiment has configuration capable of adjusting head gaps, the device controller 77 may control ejection timings according to the head gaps, similarly to the above-explained first embodiment.

Ink in the ink chambers of the downstream head(s) 13B may be heated by a "precursor operation". The precursor operation is an operation to generate micro-vibration by the piezoelectric element to the extent that ink droplets are not ejected from the nozzles 14. By the precursor operation, ink temperature can be increased. In this case, the device controller 77 controls the piezoelectric element(s) before ejection of ink droplets to increase ink temperature of ink in the ink chambers of the downstream head(s) 13B by the precursor operation.

Note that the control of drive voltage waveform and/or drive voltage magnitude in the first embodiment and the control of ink temperature in the present embodiment may be executed in combination.

Third Embodiment

In an inkjet printer 1 according to a third embodiment, image data (drop data) is converted by reallocating ink droplets defined in the image data to nozzles 14 on the downstream head(s) 13B so as to decrease the number of nozzles 14 to be used for ejection of the ink droplets and to increase the number of ink droplets to be sequentially ejected from each of the nozzles 14 to be used, the upstream head(s) 13A and the downstream head(s) 13B are controlled independently from each other based on the converted image data. Note that components in the present embodiment that are identical or similar to those in the above-explained first or second embodiment are indicated by identical reference numerals, so that redundant explanations for the identical or similar components will be omitted hereinafter. The inkjet printer 1 according to the present embodiment has the same configuration as shown in FIGS. 1, 3 and 7.

Figure 12:
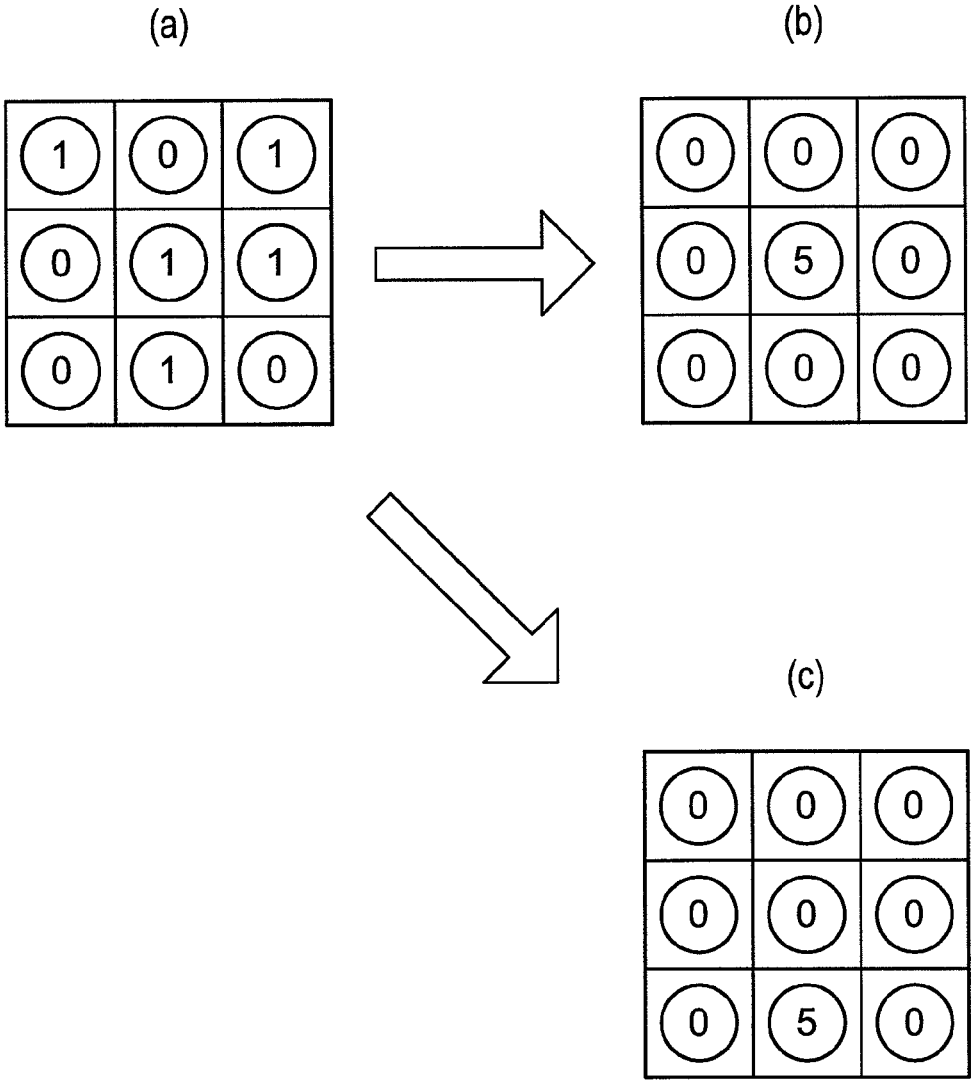
FIG. 12 is a diagram showing image data used by an inkjet printer according to a third embodiment, (a) is an example of the image data before conversion, (b) is an example of the image data after the conversion, and (c) is another example of the image data after the conversion.

For example, FIG. 12(*a*) shows a partial area composed of three pixels×three pixels (a segment unit for conversion) defined in the image data (drop data) generated by image processing unit 75 before the conversion. A number indicates the number of ink droplets need for each of the pixels. Here, the more ink droplets are ejected sequentially from a single nozzle 14, the larger propulsive forces the ink droplets can get by the so-called slipstream effect. In addition, according to the sequential ejection of ink droplets, the sequentially ejected ink droplets forms airflow by themselves, and thereby become hard to be affected by the above-explained airflow W2 caused by the ink wall 42.

Therefore, when it is judged, by the judgment unit 76, that the ink wall 42 is to be generated by ejection of ink droplets from the nozzles 14 on the upstream head(s) 13A, ink droplets defined in the image data are reallocated to nozzles 14 on the downstream head(s) 13B so as to decrease the number of nozzles 14 to be used for ejection of the ink droplets and to increase the number of ink droplets to be sequentially ejected from each of the nozzles 14 to be used. Specifically in the present embodiment, all ink droplets within each segment unit (nine square pixels) defined in the image data are reallocated to a single nozzle 14 (e.g. the center of the segment unit) as shown in FIG. 12(*b*). As a result, sequentially ejected five ink droplets are landed onto the center of the segment unit. In this manner, the image data (drop data) (FIG. 12(*a*)) are converted to a new image data (FIG. 12(*b*)) by the image processing unit 75. Note that print density for each segment unit is not changed by this conversion. In addition, the image processing unit 75 may generate the image data (drop data) as shown in FIG. 12(*b*) based on the image data retrieved by the image scanning unit 2.

FIG. 12(*c*) shows another conversion method. The image processing unit 75 may generate the image data (drop data), similarly to the so-called error diffusion method, by comparing values with a threshold value (e.g. "5") from left to right and upper to lower pixels and incrementing the values until the incremented value reaches to the threshold value. When the incremented value reaches to the threshold value, the threshold value "5" is allocated to a pixel where the incremented value reaches to the threshold value. By this method, the segment unit shown in FIG. 12(*a*) is converted to the segment unit shown in FIG. 12(*c*) that has the threshold value "5" at the lower center pixel.

Then, the device controller 77 controls the upstream head(s) 13A and the downstream head(s) 13B are independently from each other based on the converted image data.

According to the present embodiment, in a case where the ink wall 42 may be formed by ink droplets ejected from the nozzles 14 on the upstream head 13A, displacements of ink dots made by ink droplets ejected from the nozzles 14 on the downstream head 13B are restricted by the above-explained conversion of the image data. Note that, if the inkjet printer 1 according to the present embodiment has configuration capable of adjusting head gaps, the device controller 77 may control ejection timings according to the head gaps, similarly to the above-explained first embodiment.

In addition, according to the present embodiment, the upstream head(s) 13A and the downstream head(s) 13B are independently from each other without changing drive voltage waveform and/or magnitude, so that energy consumption can be also reduced.

As the number of sequentially ejected ink droplets becomes large, ballistic speed of the sequentially ejected ink droplets becomes hard to reduce (the sequentially ejected ink droplets become hard to decelerate). Therefore, the device controller 77 controls ejection timings of the sequentially ejected ink droplets according to the ejection speed of the sequentially ejected ink droplets. Specifically, the device controller 77 delays ejection timings of the ink droplets to be sequentially ejected from the nozzle(s) 14 on the downstream head(s) 13B to compensate for the ballistic speed that becomes hard to reduce so that the ink droplets land at their desired positions.

Even if the ejection speed of ink droplets ejected from the nozzles 14 on the downstream head 13B is relatively differentiated, due to difference of the number of sequentially ejected ink droplets, from the ejection speed of ink droplets ejected from the nozzles 14 on the upstream head 13A, the ink droplets can land at their desired positions.

Figure 13A:
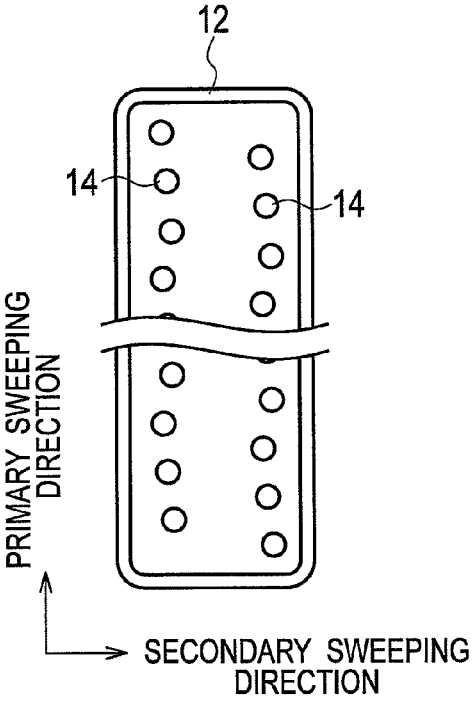
FIG. 13A is a bottom view of a modified head block.
Figure 13B:
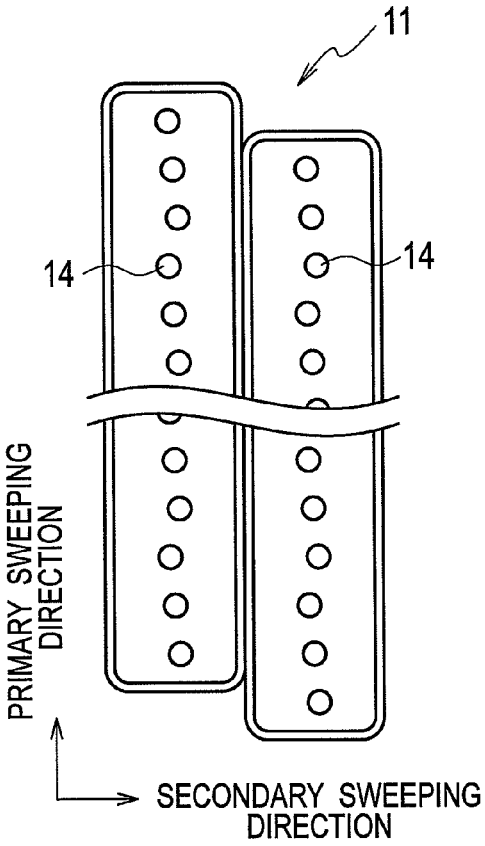
FIG. 13B is a bottom view of a modified inkjet head.

In addition, in the above embodiments, each of the head blocks 12 is constituted of the upstream head 13A having a single nozzle row and the downstream head 13B having a single nozzle row as shown in 2A. And, the head blocks 12 are arranged in a staggered manner as shown in FIG. 1. However, each of the head blocks 12 may have two nozzle rows each extends along the primary sweeping direction as shown in FIG. 13A, or may have three or more nozzle rows.

Further, in the above embodiments, each of the inkjet heads 11 is constituted of plural head blocks 12 as shown in FIG. 1. However, each of the inkjet heads 11 may be constituted to include nozzle rows each for a single color, and each of the nozzle rows extends along the primary sweeping direction from one end of the inkjet heads 11 to another end.

Also in these cases, according to the inkjet printer 1, ejection of ink droplets from an upstream nozzle row on an inkjet head 11 and ejection of ink droplets from a downstream nozzle row on the on the inkjet head 11 are controlled individually from each other so that propulsive forces applied to ink droplets ejected from the downstream nozzle row are made larger than propulsive forces applied to ink droplets ejected from the upstream nozzle row. Therefore, the propulsive forces applied to ink droplets ejected from the nozzles 14 on the downstream head 13B (in the downstream nozzle row) is mage larger than the propulsive forces applied to ink droplets ejected from the nozzles 14 on the upstream head 13A (in the upstream nozzle row), so that the ink droplets ejected from the nozzles 14 on both the upstream head 13A and the downstream head 13B (in the upstream nozzle row and the downstream nozzle row) can land at their desired (target) positions on a print sheet P without being affected by the airflow flowing around behind the ink wall. As a result, high-quality printed image without density/color unevenness and faintness can be formed on the print sheet P.

Note that, in the above embodiments, the control unit 7 judges that a print request is made when an operational signal for requesting printing is supplied to the control unit 7 from the operation unit 6. However, the control unit 7 may judge that a print request is made when a print job is supplied to the control unit 7 from a terminal via a network.

In addition, the inkjet head 11Y for yellow (Y) may be excluded from the above-explained control for improving propulsive forces in order to simplify the control. The reason is that yellow dots formed by yellow ink droplets are not easily visible, and their displacements are hardly distinct. The displacements of yellow ink dots may not become problematic.

In addition, in the above embodiments, the present invention is applied to the line-type inkjet printer 1 that includes the plural inkjet heads 11 for ejecting ink aligned along a direction (=the primary sweeping direction) perpendicular to the feeding direction (=the secondary sweeping direction) of a print sheet P fed on a sheet feed path. But, the present invention may be applied to a serial type inkjet printer in which inkjet heads eject ink droplets onto a print sheet intermittently fed along a secondary sweeping direction while moving along a primary sweeping direction. Even in a serial type inkjet printer, airflow generated by movement of the inkjet heads transmutes to airflow flowing around behind an ink wall formed by ink droplets ejected from an upstream nozzle row, and thereby ink droplets ejected from an upstream nozzle row may affected by the airflow. Therefore, the present invention is also effective to a serial type inkjet printer. Note that, in a serial type inkjet printer, a primary direction along which inkjet heads moves corresponds to the printing direction defined in Claims of the present application.

As explained above, the present invention can be applied to any inkjet printer that moves plural nozzle row relatively to a print medium and prints images on the print medium based on image data.

The present invention is not limited to the above-mentioned embodiment, and it is possible to embody the present invention by modifying the components in the range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

The present application claims the benefit of priorities under 35 U.S.C §119 to Japanese Patent Application No. 2012-1378, filed on Mar. 23, 2012, and Japanese Patent Application No. 2012-200385, filed on Sep. 12, 2012, the entire content of which is incorporated herein by reference.

What is claimed is:

1. An inkjet printer comprising:

a plurality of nozzle rows aligned along a printing direction along which printing on a print medium is executed; and a controller configured to control ejection of ink droplets from the plurality of nozzle rows, wherein the controller executes printing on the print medium by ejecting ink droplets from the plurality of nozzle rows onto the print medium while moving the plurality of nozzle rows relatively to the print medium based on image data, the plurality of nozzle rows includes a pair of an upstream nozzle row and a downstream nozzle row, the upstream nozzle row being positioned just upstream from the downstream nozzle row along the printing direction, the controller controls ejection of the ink droplets from the upstream nozzle row and the downstream nozzle row so that propulsive forces applied to ink droplets ejected from the downstream nozzle row are made larger, based on image data associated with the upstream nozzle row, than propulsive forces applied to ink droplets ejected from the upstream nozzle row, wherein the image data are multiple-valued data for allocating ink droplets to be ejected to nozzles in the plurality of nozzle rows; and an image processing unit that converts the image data by reallocating ink droplets allocated to nozzles in the downstream nozzle row so as to decrease the number of nozzles to be used for ejection of the ink droplets and to increase the number of ink droplets to be sequentially ejected from each of the nozzles to be used, wherein the controller controls ejection of ink droplets from the upstream nozzle row and the downstream nozzle row independently from each other based on the image data converted by the image processing unit.

2. The inkjet printer according to claim 1, wherein the controller makes the propulsive forces applied to ink droplets ejected from the downstream nozzle row larger by executing at least one of (a) a control for setting drive voltage waveforms for ejecting the ink droplets from the upstream nozzle row and the downstream nozzle row so that ejection speed of ink droplets ejected from the downstream nozzle row is made faster than ejection speed of ink droplets ejected from the upstream nozzle row, (b) a control for setting for setting drive voltage magnitudes for ejecting the ink droplets from the upstream nozzle row and the downstream nozzle row so that ejection speed of ink droplets ejected from the downstream nozzle row is made faster than ejection speed of ink droplets ejected from the upstream nozzle row, and (c) a control for heating ink to be ejected as ink droplets ejected from the downstream nozzle so that ejection speed of the ink droplets ejected from the downstream nozzle row is made faster than ejection speed of ink droplets ejected from the upstream nozzle row.

3. The inkjet printer according to claim 1, wherein the controller is configured to control ejection timings of ink droplets to be ejected from the downstream nozzle row according to ejection speeds of the ink droplets.

4. The inkjet printer according to claim 1, wherein the controller is configured to control ejection timing of ink droplets to be ejected from the downstream nozzle row according to a distance between the downstream nozzle row and the print medium.

5. The inkjet printer according to claim 1, wherein the controller judges, based on the image data, whether or not ejection of ink droplets from the upstream nozzle affects landing positions of ink droplets from the downstream nozzle row, and, when it is judged that the ejection of the ink droplets from the upstream nozzle row affects the landing positions of the ink droplets from the downstream nozzle row, controls the ejection of the ink droplets from the upstream nozzle row and ejection of ink droplets from the downstream nozzle row so that propulsive forces applied to ink droplets ejected from the downstream nozzle row are made larger, based on image data associated with the upstream nozzle row, than propulsive forces applied to ink droplets ejected from the upstream nozzle row.

6. An inkjet printer comprising:

a plurality of nozzle rows each extending along a direction perpendicular to a feeding direction along which a print medium is fed; and a controller configured to control ejection of ink droplets from the plurality of nozzle rows, wherein the controller executes printing on the print medium by ejecting ink droplets from the plurality of nozzle rows onto the print medium while moving the print medium relative to the plurality of nozzle rows based on image data, the plurality of nozzle rows includes a pair of an upstream nozzle row and a downstream nozzle row, the upstream nozzle row being positioned just upstream from the downstream nozzle row along the feeding direction, each of the upstream nozzle row and the downstream nozzle row includes a plurality of nozzles along the direction perpendicular to the feeding direction, the upstream nozzle row and the downstream nozzle row are fixedly disposed, and parallel to each other, and the controller controls ejection of the ink droplets from the upstream nozzle row and the downstream nozzle row so that propulsive forces applied to ink droplets ejected from the downstream nozzle row are made larger, based on image data associated with the upstream nozzle row, than propulsive forces applied to ink droplets ejected from the upstream nozzle row.

7. The inkjet printer according to claim 6, wherein the controller makes the propulsive forces applied to ink droplets ejected from the downstream nozzle row larger by executing at least one of (a) a control for setting drive voltage waveforms for ejecting the ink droplets from the upstream nozzle row and the downstream nozzle row so that ejection speed of ink droplets ejected from the downstream nozzle row is made faster than ejection speed of ink droplets ejected from the upstream nozzle row, (b) a control for setting for setting drive voltage magnitudes for ejecting the ink droplets from the upstream nozzle row and the downstream nozzle row so that ejection speed of ink droplets ejected from the downstream nozzle row is made faster than ejection speed of ink droplets ejected from the upstream nozzle row, and (c) a control for heating ink to be ejected as ink droplets ejected from the downstream nozzle so that ejection speed of the ink droplets ejected from the downstream nozzle row is made faster than ejection speed of ink droplets ejected from the upstream nozzle row.

8. The inkjet printer according to claim 6, wherein the image data are multiple-valued data for allocating ink droplets to be ejected to nozzles in the plurality of nozzle rows, the inkjet printer further comprises an image processing unit that converts the image data by reallocating ink droplets allocated to nozzles in the downstream nozzle row so as to decrease the number of nozzles to be used for ejection of the ink droplets and to increase the number of ink droplets to be sequentially ejected from each of the nozzles to be used, and the controller controls ejection of ink droplets from the upstream nozzle row and the downstream nozzle row independently from each other based on the image data converted by the image processing unit.

9. The inkjet printer according to claim 6, wherein the controller is configured to control ejection timings of ink droplets to be ejected from the downstream nozzle row according to ejection speeds of the ink droplets.

10. The inkjet printer according to claim 6, wherein the controller is configured to control ejection timing of ink droplets to be ejected from the downstream nozzle row according to a distance between the downstream nozzle row and the print medium.

11. The inkjet printer according to claim 6, wherein the controller judges, based on the image data, whether or not ejection of ink droplets from the upstream nozzle affects landing positions of ink droplets from the downstream nozzle row, and, when it is judged that the ejection of the ink droplets from the upstream nozzle row affects the landing positions of the ink droplets from the downstream nozzle row, controls the ejection of the ink droplets from the upstream nozzle row and ejection of ink droplets from the downstream nozzle row so that propulsive forces applied to ink droplets ejected from the downstream nozzle row are made larger, based on image data associated with the upstream nozzle row, than propulsive forces applied to ink droplets ejected from the upstream nozzle row.

* * * * *